US007791003B2

(12) United States Patent
Lockhart et al.

(10) Patent No.: US 7,791,003 B2
(45) Date of Patent: Sep. 7, 2010

(54) COLLAPSIBLE INSULATED FOOD DELIVERY BAG

(75) Inventors: Edward A. Lockhart, Rosemont (CA); Mervin S. Ozechowsky, North York (CA)

(73) Assignee: CoverTex Corporation, Brampton, Ontario (CA)

( * ) Notice: Subject to any disclaimer, the term of this patent is extended or adjusted under 35 U.S.C. 154(b) by 657 days.

(21) Appl. No.: 11/796,845

(22) Filed: Apr. 30, 2007

(65) Prior Publication Data

US 2008/0264925 A1 Oct. 30, 2008

(51) Int. Cl.
*A21B 1/52* (2006.01)
*B65D 33/00* (2006.01)

(52) U.S. Cl. ..... 219/387; 219/533; 383/94; 62/457.7; 62/371

(58) Field of Classification Search ..... 219/986, 219/387, 533; 383/94; 62/457.7, 371
See application file for complete search history.

(56) References Cited

U.S. PATENT DOCUMENTS 6,060,696 A 5/2000 Bostic
6,192,703 B1 * 2/2001 Salyer et al. ..... 62/457.7
6,248,981 B1 6/2001 Check
6,281,477 B1 8/2001 Forrester et al.
6,512,211 B1 1/2003 Lockhart et al.

* cited by examiner

*Primary Examiner*—Shawntina Fuqua
(74) *Attorney, Agent, or Firm*—Jacox, Meckstroth & Jenkins

(57) ABSTRACT

An insulated bag has generally flat top and bottom walls connected by foldable back and opposite side walls which cooperate to define a chamber having a front opening for receiving a food product. Flexible closure flaps extend from the bottom wall and opposite side walls and have releasable fasteners for closing the front opening. Each wall has an outer fabric covering and a porous inner liner and also inner and outer layers of flexible thermal insulation material. A vapor barrier film separates the inner and outer layers of insulation material in each wall and provides for moisture absorption by the inner layers. The top and bottom walls each have a compartment with an edge opening closed by a releasable fastener, and a vacuum insulation panel is confined within each compartment. The top and bottom walls move between a collapsed storage position and an expanded position to receive the product.

14 Claims, 2 Drawing Sheets

COLLAPSIBLE INSULATED FOOD DELIVERY BAG

BACKGROUND OF THE INVENTION

This invention relates to an expandable and collapsible insulated food delivery bag commonly used for delivering food products such as a hot pizza within a paperboard box and of the general type disclosed in U.S. Pat. No. 6,512,211 which issued to the assignee of the present invention. In the insulated bag or pouch disclosed in this patent, a heating element is carried by the bottom wall of the bag for maintaining the temperature of a hot food product or pizza. Other forms of heated food or pizza delivery bags are disclosed in U.S. Pat. Nos. 6,060,696, 6,248,981 and 6,281,477. The bags disclosed in these patents are made to receive one or more boxes enclosing pizzas and also carry heating elements.

It is also known to construct a box-like pizza delivery bag for delivering multiple paperboard pizza boxes and in which rigid top, bottom and side walls of the box-like bag are provided with removable vacuum insulation panels. The rigid bag may also incorporate a heating element or hot packs for maintaining the heated temperature of the multiple pizza boxes within the bag. Such a bag has been manufactured and marketed by AcuTemp in Dayton, Ohio and sold under the trademark ThermoPocket. This company also owns U.S. Pat. No. 6,192,703 which discloses a box-like insulated container having vacuum insulated panels for delivering temperature-sensitive materials including food products such as pizza. The container may also incorporate a refrigeration unit for maintaining the temperature-sensitive material at a substantially constant temperature during shipment.

SUMMARY OF THE INVENTION

The present invention is directed to an improved thermal insulated delivery bag which is ideally suited for transporting or delivering hot or cold food products such as one or more boxes of hot pizza and which substantially reduces the heat transfer to or from the food product or pizza during delivery and which is also adapted to absorb moisture to prevent the food product or pizza from becoming soggy and remaining crisp. The delivery bag of the invention is also partially collapsible to minimize air space when only one pizza box is being delivered and fully collapsible to minimize the occupied space when an empty bag is being returned to the source for the food product or pizza.

In accordance with the illustrated embodiment of the invention, a collapsible thermally insulated bag is adapted for delivering a food product such as one or more paperboard boxes enclosing hot pizza, and includes generally flat top and bottom walls connected by foldable side walls and a foldable back wall. The walls define an internal chamber having a front opening, and flexible insulated front and side closure flaps extend from the bottom wall and side walls for releasably closing the front opening. All of the walls and closure flaps have inner and outer pads or layers of flexible thermal insulation material and a vapor barrier film is located between the inner and outer layers. The top and bottom walls each have a compartment with an edge portion defining an opening with a releasable fastener for receiving a vacuum insulation panel having an evacuated core material within a sealed air impervious film. The foldable side and back walls provide for movement of the top and bottom walls and the corresponding vacuum insulation panels between a fully collapsed storage position and an expanded position to receive the food product such as one or more pizza boxes.

Other features and advantages of the invention will be apparent from the following description, the accompanying drawings and the appended claims.

DESCRIPTION OF THE ILLUSTRATED EMBODIMENT

Figure 4:
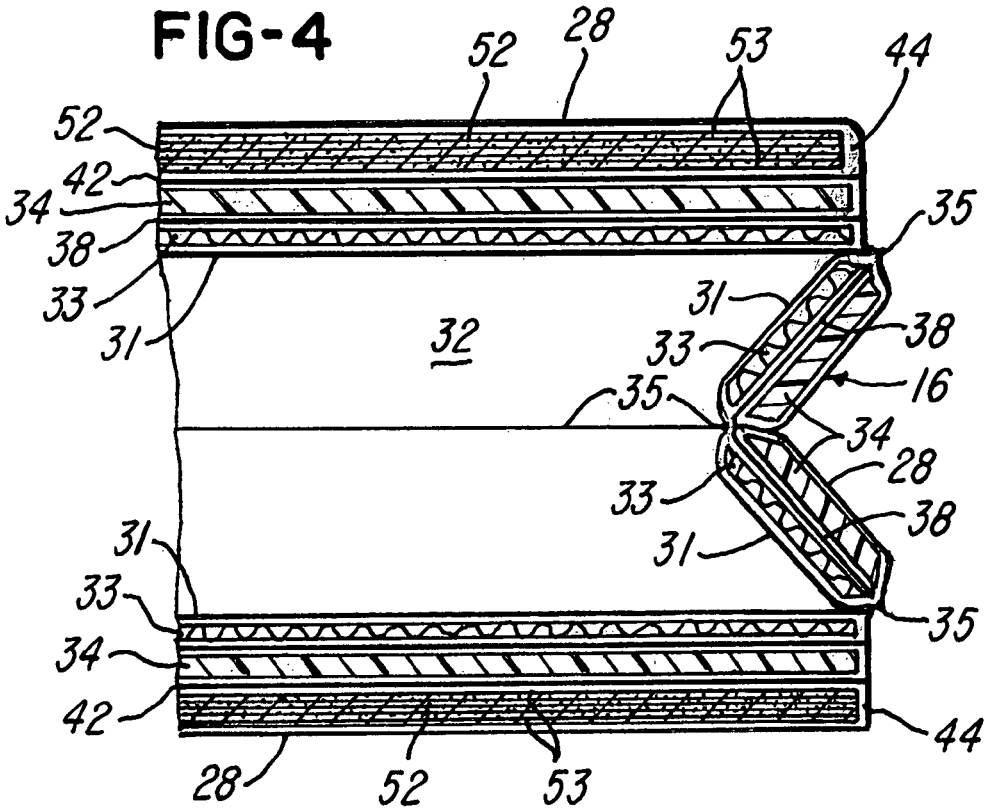
FIG. 4 is an enlarged fragmentary section of the partially expanded bag, taken generally on the line 4-4 of FIG. 1.

A collapsible thermal insulated food delivery bag 10 includes a generally flat top wall 12 and a generally flat bottom wall 14 which are connected by a flexible or foldable back wall 16 (FIG. 4) and flexible or foldable opposite side walls 18 which have the same construction as the back wall 16 shown in FIG. 4. A flexible or foldable front closure panel or flap 22 extends from the bottom wall 14, and flexible or foldable side closure panels or flaps 24 and 26 project from the opposite side walls 18. All of the walls and closure flaps have an outer fabric covering 28, preferably in the form of a 600 denier polyester fabric having a polyvinylchloride (PVC) coating on its inner surface to provide water resistance. The outer fabric covering 28 on the top wall, back wall and side walls is die cut from one piece of fabric, and the outer fabric coverings 28 on the bottom wall and closure flaps 22, 24 and 26 are stitched to the adjacent walls.

All of the top, bottom, side and back walls and closure flaps have an inner fabric liner 31 which defines a product receiving chamber 32, and the liner is preferably in the form of a 420 denier nylon material with a water base polyurethane coating on the outer surface of the liner material. All of the walls and closure flaps also include an inner pad or layer 33 and an outer pad or layer 34 of flexible insulation material. For example, the inner flexible pad or layer 33 may be a fibrous insulation pad produced by the 3M Corporation and sold under the trademark "Thinsolate". The outer flexible pad or layer 34 may be a nine ounce needle punched polyester material. The covering 28 and liner 31 and flexible inner insulation pad 33 and outer flexible insulation pad 34 within the top wall 12 extend continuously through the back and side walls and receive stitches 35 which form hinges for the foldable back and side walls. Preferably, the fabric material forming the inner liner 31 is porous or air permeable so that moisture may be absorbed by the inner pad or layer 33 of insulation material. A vapor barrier film 38 is located or confined between the inner and outer insulation pads or layers 33 and 34 within all of the walls and closure flaps and confines any moisture absorption to the inner insulation pad or layer 33.

The top wall 12 and bottom wall 14 each include an intermediate fabric wall panel 42 which is formed of the same material or fabric as the outer covering 28 and cooperates with the outer covering 28 to define a full pocket 44 within the top wall 12 and within the bottom wall 14. A substantially flat and substantially rigid vacuum insulation panel 50 is inserted into each of the pockets 44 within the top wall 12 and bottom wall 14 between the outer covering 28 and panel 42. Each panel 50 is formed by an evacuated open cell or fibrous core material 52 confined within a sealed enclosure of an air and gas impervious film 53. Preferably, the vacuum insulation panels 50 are produced by AcuTemp in Dayton, Ohio and sold under the trademark "ThermoCore".

Figure 1:
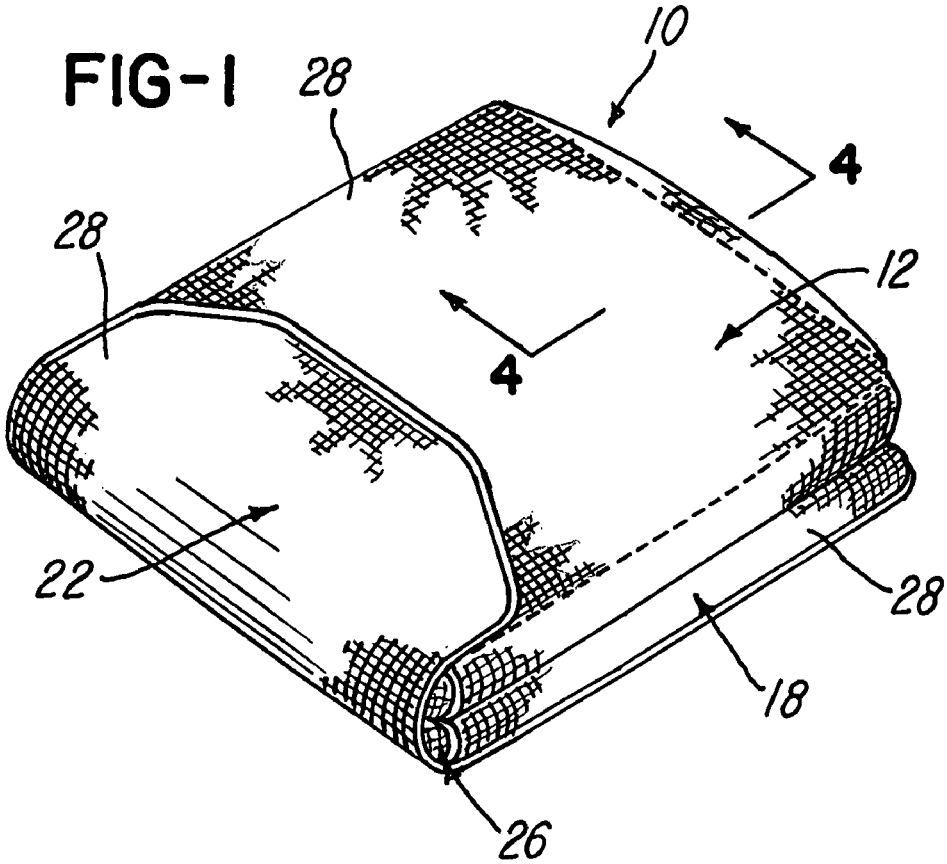
FIG. 1 is a perspective view of an insulated delivery bag constructed in accordance with the invention and shown in a partially expanded and closed condition.
Figure 2:
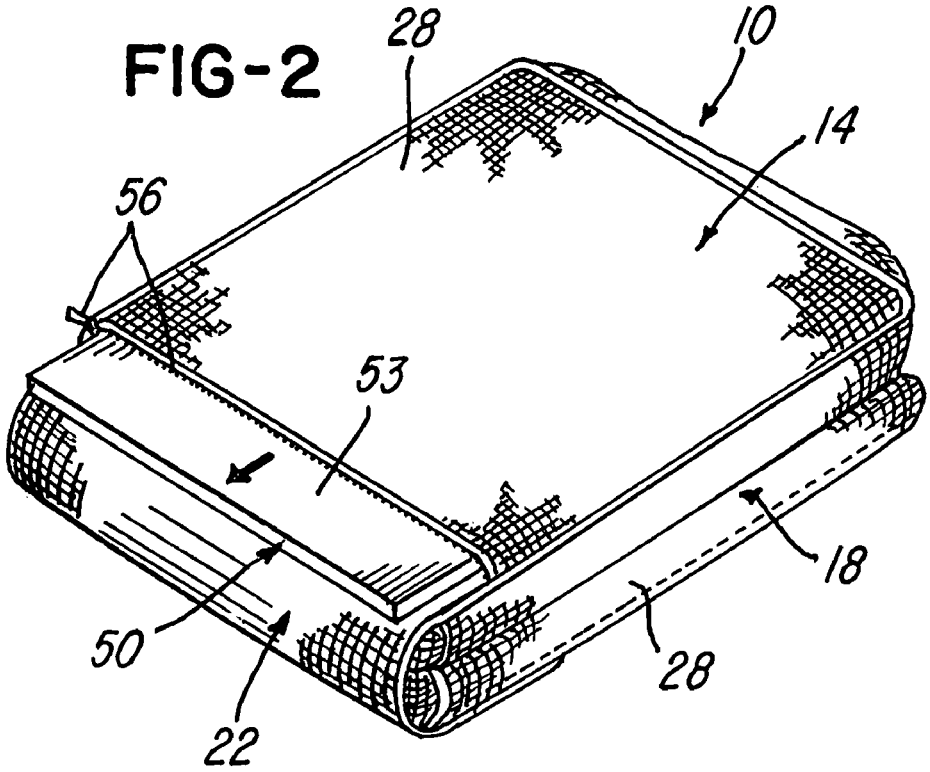
FIG. 2 is another perspective view of the delivery bag of FIG. 1 and showing the bottom wall with a partially removed vacuum insulation panel.
Figure 3:
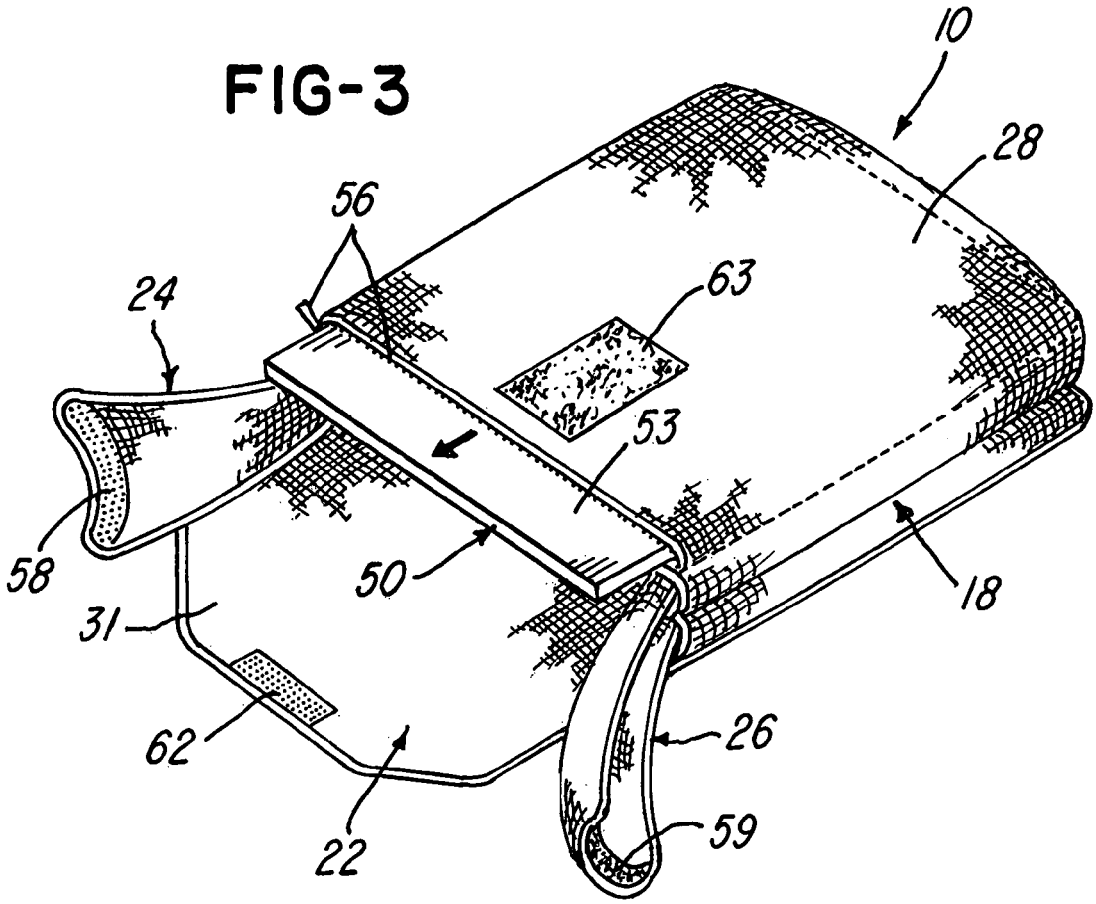
FIG. 3 is a perspective view of the delivery bag of FIG. 1 and in its open condition and with a vacuum insulation insulating panel partially removed from the top wall.

Each of the pockets 44 has an open edge portion for receiving and removing the corresponding insulation panel 50, as shown in FIGS. 2 & 3, and each of the pockets is closed by a releasable fastener in the form of a zipper 56 which connects the outer covering 28 and panel 42. The panel 42 and the layers 33 and 34 of insulation within the bottom wall 12 extend continuously into the front closure flap 22 and are stitched together at the corresponding zipper 56. As also shown in FIG. 3, the side closure flaps 24 and 26 are releasably attached to each other by a releasable fastener such as a "Velcro" hook and loop fastener members or strips 58 & 59. The closure flap 22 is attached to the top wall covering 28 by a releasable fastener, also preferably in the form of "Velcro" strips or pads 62 & 63.

From the drawings and the above description, it is apparent that a thermal insulated delivery bag constructed in accordance with the invention, provides desirable features and advantages. That is, the construction of the top wall 12 and bottom wall 14 with the inner and outer insulation pads or layers 33 & 34 and the upper and lower vacuum insulation panels 50 in combination with the foldable back wall 16 and side walls 18 provide for a highly insulated bag which may be completely collapsed for storage and transporting when empty and may also be expanded for receiving one or more heated food products or pizzas in boxes with minimum dead air space within the internal chamber 32. In addition, the flexible insulated closure flap 22 and side closure flaps 24 positively close the internal chamber 32 both when there is only one heated food container in the chamber 32 or multiple heated food containers. As another feature, the air impervious barrier film 38 within each of the walls and closure flaps cooperates with the air permeable inner fabric liner and the inner pad or layer 33 of fiber insulation material to absorb moisture escaping from the heated food product through the container or containers or paperboard boxes so that the food product does not become soggy during transport or delivery.

While the form of insulated bag herein described constitutes one desired embodiment of the invention, it is to be understood that the invention is not limited to this precise form of bag, and that changes may be made therein without departing from the scope and spirit of the invention as defined in the appended claims.

What is claimed is:

1. An insulated bag adapted for delivering a food product such as a hot pizza enclosed within a box, said bag comprising a generally flat top wall and a generally flat bottom wall connected together by a foldable back wall and opposing foldable side walls, said top, bottom, side and back walls defining a chamber having a front opening, a flexible insulated front closure flap extending from said bottom wall for closing said front opening and connectable to said top wall by a releasable fastener, said top, bottom, side and back walls having layers of flexible thermal insulation material, said top wall and said bottom wall each having a compartment with an edge portion defining an opening closed by a releasable fastener, a vacuum insulation panel within each of said compartments and including an evacuated core material within a sealed enclosure of film material, said foldable side and back walls providing for movement of said top and bottom walls and the corresponding said vacuum insulation panels between a collapsed position for storage and an expanded position for receiving the product within said chamber through said front opening, and said top and bottom walls each including an inner liner of air permeable material, one of said layers of flexible insulation material adjacent each said inner liner and adapted to absorb moisture passing from the product through said inner liner, and a film of vapor barrier material adjacent each one of said layers of flexible insulation material.

2. An insulated bag as defined in claim 1 and including flexible insulated side closure flaps projecting from said side walls on opposite sides of said front opening, and said insulated side closure flaps cooperating with said insulated front closure flap extending from said bottom wall for closing said chamber completely around said front opening.

3. An insulated bag as defined in claim 1 wherein said film of vapor barrier material comprises a film of metal foil.

4. An insulated bag as defined in claim 1 wherein each of said foldable side and back walls includes an inner liner of air permeable material, one of said layers of flexible insulation material adjacent each said inner liner of said side and back walls and adapted to absorb moisture from the product through said inner liner, and a film of vapor barrier material adjacent each one of said layers of flexible insulation material within said side and back walls.

5. An insulated bag as defined in claim 1 wherein each of said walls of said bag include an outer fabric covering and an inner liner of air permeable material, and said fabric covering, said liner and said layer of flexible insulation material within said bottom wall extend continuously into said front closure flap.

6. An insulated bag as defined in claim 5 wherein said fabric covering, said liner and said layer of flexible insulation material within said top wall extend continuously into said foldable side and back walls.

7. An insulated bag as defined in claim 6 wherein said foldable back wall and said foldable side walls have center portions with stitches extending through the corresponding said fabric coverings, said liners and said layers of insulation material to form flexible hinge connections within said center portions.

8. An insulated bag as defined in claim 6 wherein said foldable back wall and said foldable side walls and said top wall have adjacent edge portions with stitches extending through the corresponding said fabric coverings, said liners and said layers of insulation material to form flexible hinge connections connecting said adjacent edge portions of said walls.

9. An insulated bag adapted for delivering a food product such as a hot pizza enclosed within a box, said bag comprising a generally flat top wall and a generally flat bottom wall connected together by a foldable back wall and opposing foldable side walls, said top, bottom, side and back walls defining a chamber having a front opening, a flexible insulated front closure flap extending from said bottom wall and flexible side closure flaps projecting from said side walls for closing said front opening, said top, bottom, side and back walls having layers of flexible thermal insulation material, said top and bottom walls each including an inner liner of air permeable material, one of said layers of flexible insulation material adjacent each said inner liner and adapted to absorb moisture passing from the product through said inner liner, a film of vapor barrier material adjacent each one of said layers of flexible insulation material, said top wall and said bottom wall each having a compartment with an edge portion defining an opening closed by a releasable fastener, a vacuum insulation panel within each of said compartments and including an evacuated core material within a sealed enclosure of film material, and said foldable side and back walls providing for movement of said top and bottom walls and the corresponding said vacuum insulation panels between a collapsed position for storage and an expanded position for receiving the product within said chamber through said front opening, and each of said foldable side and back walls including an inner liner of air permeable material, one of said layers of flexible insulation material adjacent each said inner liner of said side and back walls and adapted to absorb moisture from the product through said inner liner, and a film of vapor barrier material adjacent each one of said layers of flexible insulation material within said side and back walls.

10. An insulated bag as defined in claim 9 wherein each of said walls of said bag include an outer fabric covering and said inner liner of air permeable material, and said fabric covering, said liner and said layer of flexible insulation material within said bottom wall extend continuously into said front closure flap.

11. An insulated bag as defined in claim 10 wherein said fabric covering, said liner and said layer of flexible insulation material within said top wall extend continuously into said foldable side and back walls.

12. An insulated bag as defined in claim 9 wherein said foldable back wall and said foldable side walls have center portions with stitches extending through the corresponding said fabric coverings, said liners and said layers of insulation material to form flexible hinge connections within said center portions.

13. An insulated bag as defined in claim 9 wherein said foldable back wall and said foldable side walls and said top wall have adjacent edge portions with stitches extending through the corresponding said fabric coverings, said liners and said layers of insulation material to form flexible hinge connections between said adjacent edge portions of said walls.

14. An insulated bag adapted for delivering a food product such as a hot pizza enclosed within a box, said bag comprising a generally flat top wall and a generally flat bottom wall connected together by a foldable back wall and opposing foldable side walls, said top, bottom, side and back walls defining a chamber having a front opening, a flexible insulated front closure flap extending from said bottom wall for closing said front opening and connectable to said top wall by a releasable fastener, said top, bottom, side and back walls having layers of flexible thermal insulation material, said top wall and said bottom wall each having a compartment with an edge portion defining an opening closed by a releasable fastener, each of said compartments adapted to receive a vacuum insulation panel having an evacuated core material within a sealed enclosure of film material, said foldable side and back walls providing for movement of said top and bottom walls between a collapsed position for storage and an expanded position for receiving the product within said chamber through said front opening, and said top and bottom walls each including an inner liner of air permeable material, one of said layers of flexible insulation material adjacent each said inner liner and adapted to absorb moisture passing from the product through said inner liner, and a film of vapor barrier material adjacent each one of said layers of flexible insulation material.

* * * * *